US006471472B1

(12) United States Patent
Stauder et al.

(10) Patent No.: US 6,471,472 B1
(45) Date of Patent: Oct. 29, 2002

(54) TURBOMACHINE SHROUD FIBROUS TIP SEAL

(75) Inventors: Frank Stauder, London (CA); Ian Lockley, London (CA); Sylvain Nadeau, London (CA); William Holmes, London (CA); Alexander Graham Hunt, London (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/645,773

(22) Filed: Aug. 25, 2000

Related U.S. Application Data

(60) Provisional application No. 60/201,416, filed on May 3, 2000.

(51) Int. Cl.[7] ..... F04D 29/08

(52) U.S. Cl. ..... 415/173.4; 415/173.3; 415/119; 415/173.6

(58) Field of Search ..... 415/173.4, 173.5, 415/173.6, 173.3, 1, 119; 277/355, 415, 411

(56) References Cited

U.S. PATENT DOCUMENTS

| | | | | |
|---|---|---|---|---|
| 3,680,977 A | | 8/1972 | Rabouyt et al. | 415/172 |
| 3,719,365 A | | 3/1973 | Emmerson et al. | |
| 3,779,341 A | | 12/1973 | Huggins | |
| 3,799,128 A | * | 3/1974 | Small | 415/173.4 |
| 3,834,001 A | | 9/1974 | Carroll et al. | |
| 3,970,319 A | | 7/1976 | Carroll et al. | |
| 4,181,172 A | | 1/1980 | Longhouse | |
| 4,213,426 A | * | 7/1980 | Longhouse | 415/233 |
| 4,247,247 A | | 1/1981 | Thebert | |
| 4,396,351 A | | 8/1983 | Hayashi et al. | |
| 4,398,508 A | | 8/1983 | Moon et al. | 123/41.19 |
| 4,406,581 A | | 9/1983 | Robb et al. | |
| 4,728,257 A | | 3/1988 | Handschuh | |
| 4,859,150 A | * | 8/1989 | Takigawa | 415/119 |
| 4,971,336 A | | 11/1990 | Ferguson | |
| 4,989,886 A | * | 2/1991 | Rulis | 415/173.3 |
| 5,024,267 A | | 6/1991 | Yamaguchi et al. | |
| 5,106,104 A | | 4/1992 | Atkinson et al. | |
| 5,183,382 A | | 2/1993 | Carroll | |
| 5,335,920 A | | 8/1994 | Tseng et al. | |
| 5,342,167 A | | 8/1994 | Rosseau | |
| 5,489,186 A | | 2/1996 | Yapp et al. | |
| 5,496,045 A | | 3/1996 | Millener et al. | |
| 5,498,139 A | | 3/1996 | Williams | |
| 5,518,364 A | * | 5/1996 | Neise et al. | 415/119 |
| 5,522,698 A | | 6/1996 | Butler et al. | |
| 5,749,584 A | | 5/1998 | Skinner et al. | |
| 5,755,444 A | * | 5/1998 | Carnis et al. | 277/366 |
| 5,971,400 A | | 10/1999 | Turnquist et al. | |
| 5,980,203 A | | 11/1999 | Zatorski et al. | |
| 6,010,132 A | | 1/2000 | Bagepalli et al. | |
| 6,030,175 A | | 2/2000 | Bagepalli et al. | |
| 6,036,437 A | | 3/2000 | Wolfe et al. | |
| 6,053,699 A | | 4/2000 | Turnquist et al. | |
| 6,079,945 A | | 6/2000 | Wolfe et al. | |

FOREIGN PATENT DOCUMENTS

| | | |
|---|---|---|
| DE | G8614073.6 | 5/1988 |
| DE | 19803502 A1 | 8/1999 |

OTHER PUBLICATIONS

PCT International Search Report, mailed Aug. 17, 2001.

* cited by examiner

*Primary Examiner*—John G. Weiss
*Assistant Examiner*—Richard Woo

(57) ABSTRACT

A turbomachine for moving air comprising includes a shroud disposed about a longitudinal axis and a rotor assembly mounted for rotation about the longitudinal axis. The rotor assembly has a plurality of blades and tips of the blades are coupled to an annular band. The annular band is disposed with respect to the shroud so as to define a gap extending continuously between an outer surface of the annular band and an inner surface of the shroud. A seal structure extends from the inner surface of the shroud and into the gap. The seal structure has a density sufficient to reduce swirl in recirculating airflow and to minimize air leakage across the gap.

18 Claims, 4 Drawing Sheets

TURBOMACHINE SHROUD FIBROUS TIP SEAL

This application is based on and claims priority from U.S. Provisional Application Serial No. 60/201,416 filed on May 3, 2000, the contents of which is hereby incorporated into the present specification by reference.

FIELD OF THE INVENTION

The invention generally relates to fans for use in cooling systems. The invention relates particularly to a seal structure in a gap between the shroud and rotor of the fan to reduce noise by removing the swirling components of air flow at the tip region of fan blades and to minimize air leakage across the gap resulting in fan efficiency gains.

BACKGROUND OF THE INVENTION

Conventionally, in axial flow fans, tip seals of a labyrinth type have been used to reduce tip air leakage or the flow of air in a gap (on the order of 5 mm) between the shroud and rotor. Ribs have also been used in an effort to reduce this air leakage. A disadvantage of the labyrinth seal is that this seal is difficult to manufacture and that often the axial constraints of the vehicle limit the proper design of the seal. Ribs in the tip region only prevent the swirling component of the flow from causing turbulence by reentering the fan. However, the ribs do not seal the air leakage through the tip gap effectively.

Accordingly, there is a need to provide a seal structure to decrease the gap between the rotor and shroud and to remove the swirling components of flow in the tip region of a fan so as to reduce noise with marginal losses in static efficiency.

SUMMARY OF THE INVENTION

An object of the invention is to fulfill the need referred to above. In accordance with the principles of the present invention, this objective is achieved by providing a turbomachine for moving air. The turbomachine includes a shroud disposed about a longitudinal axis and a rotor assembly mounted for rotation about the longitudinal axis. The rotor assembly has a plurality of blades and tips of the blades are coupled to an annular band. The annular band is disposed with respect to the shroud so as to define a gap extending continuously between an outer surface of the annular band and an inner surface of the shroud. A seal structure extends from the inner surface of the shroud and into the gap. The seal structure has a density sufficient to reduce swirl of recirculating airflow and to minimize air leakage across the gap.

In accordance with another aspect of the invention, a method of reducing effects of air flow between a shroud and a rotor assembly is provided. The shroud is disposed about a longitudinal axis and the rotor assembly is mounted for rotation about the longitudinal axis. The rotor assembly has a plurality of blades and tips of the blades are coupled to an annular band. The annular band is disposed with respect to the shroud so as to define a gap extending continuously between an outer surface of the annular band and an inner surface of the shroud. The method includes providing fibers, bristles or filaments extending from the inner surface of the shroud and into the gap to reduce swirl and minimize air leakage across the gap.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
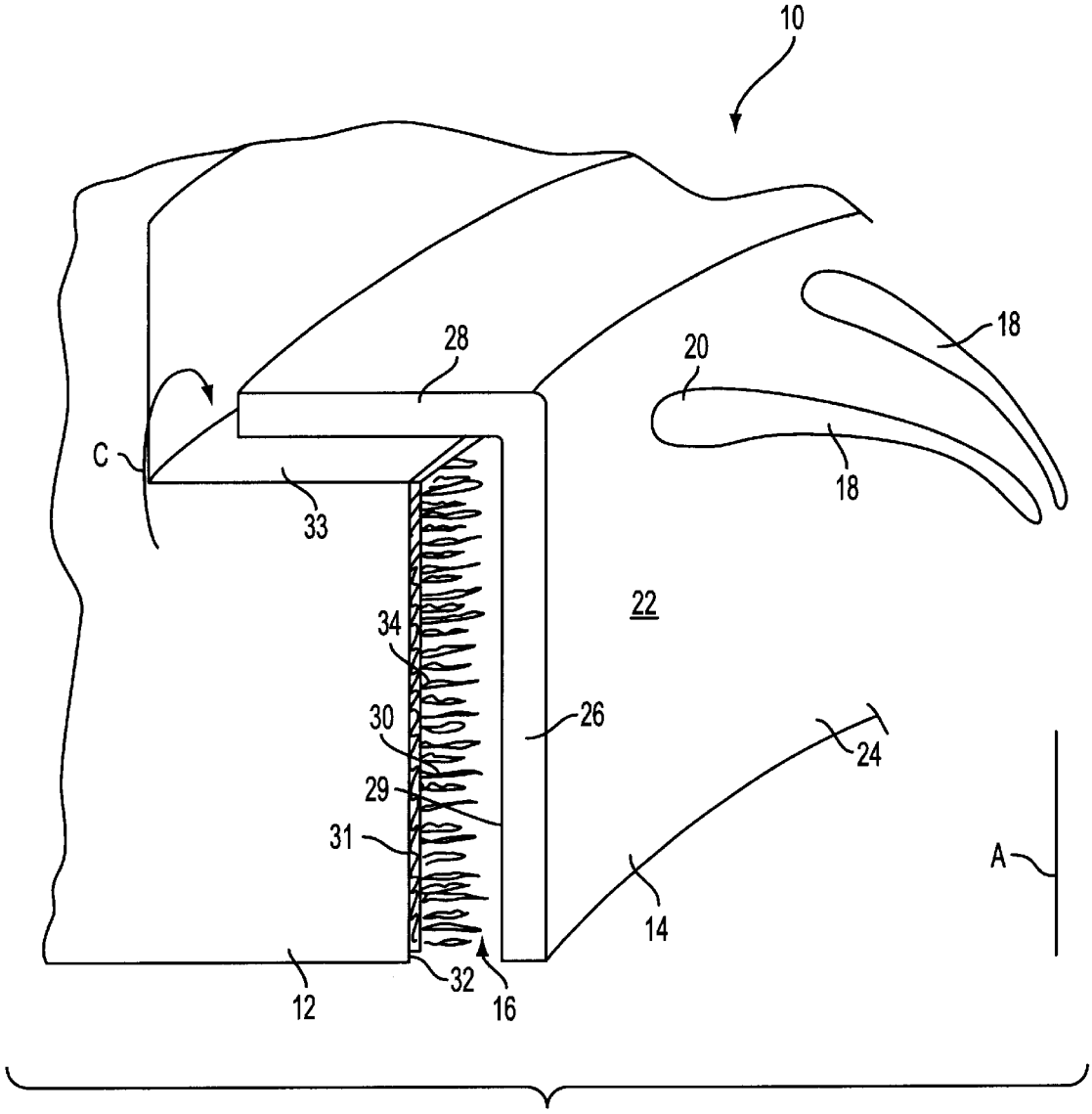
FIG. 1 is a schematic perspective view of a tip region of an axial flow fan showing seal structure in the form of fibers disposed in a gap between a shroud and rotor of the fan, provided in accordance with the principles of the present invention.

With reference to FIG. 1, a tip region of a fan, generally indicated at 10, is shown in accordance with the principles of the present invention. In the illustrated embodiment, the fan 10 is an axial flow type fan having a fixed shroud 12 disposed about a longitudinal axis A and a rotor assembly 14 rotatable about the axis A. The rotor assembly 14 is spaced from the shroud 12 to define an annular gap 16 between the shroud 12 and the rotor assembly 14. The gap 16 may be on the order of 5mm. The rotor assembly 14 includes a plurality of fan blades 18. Each blade 18 is attached to a hub (not shown) at one end thereof and a tip 20 of each blade attached to an inner peripheral wall 22 of an annular band 24.

As shown in FIG. 1, the annular band 24 is of generally L-shaped cross-section having an axially extending wall 26 and a radially extending wall 28 coupled to the axially extending wall 26. The outer surface 29 of the axial extending wall 26 defines the gap 16 with the inner surface 32 of the shroud 12. Thus, the gap 16 extends continuously between the annular band 24 and the inner surface 32 of the shroud 12 so that the annular band 24 does not strike the inner surface 32 upon rotation of the rotor assembly 14.

Figure 2:
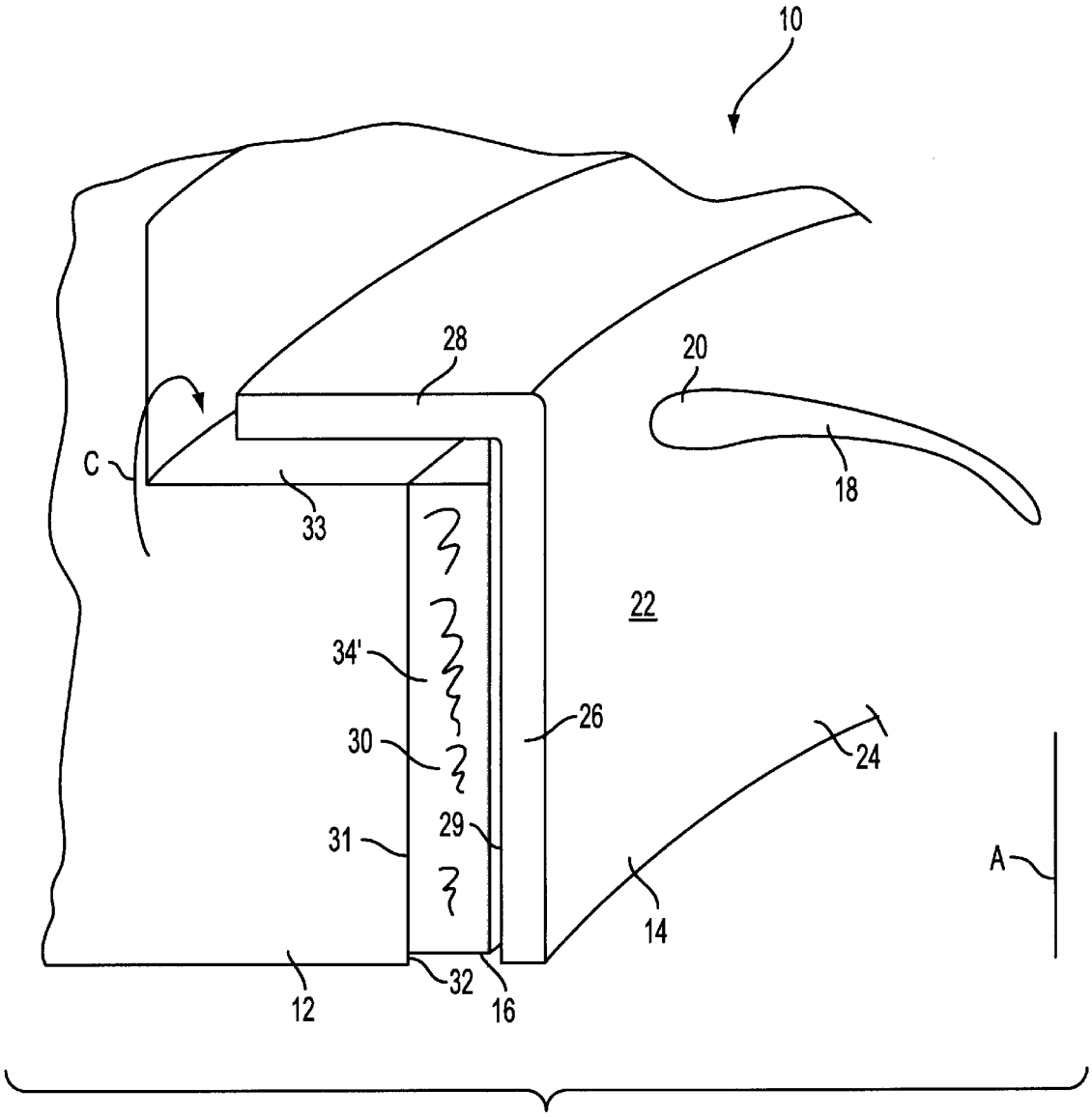
FIG. 2 is a schematic perspective view of a tip region of an axial flow fan showing seal structure disposed in a gap between a shroud and rotor of the fan in accordance with a second embodiment of the invention.

In accordance with the invention, a seal structure 30 is provided on the inner surface 32 of the shroud 12 so as to extend into the gap 16 to provide a resistance to air flow as air swirls and flows back in the direction of arrow C in FIG. 1 and into the gap 16 and to minimize air leakage across the gap 16. The seal structure 30 can be attached to the surface 32 of the shroud 12 by any adhesive 31 or may be molded or otherwise formed integrally with the shroud 12. For example, the seal structure may comprise a plurality of fibers formed in small holes made in the walls of the shroud mold cavity. Further, the surface 32 may include a groove with the seal structure 30 being slid into the groove. In the embodiment shown in FIG. 1, the seal structure 30 comprises a plurality of bristles, filaments or fibers 34 in a dense array, such as, for example, either the loop portion or the hook portion of the conventional hook and loop type fastening system (Velcro®). Thus, the seal structure 30 can comprise a plurality of elastic members mounted on a substrate and adhered to surface 32. Surface 33 of the shroud can also include the seal structure 30. As shown in FIG. 2, the seal structure 30 can comprise foam, rubber and other types of flexible, air penetrable material 34', or a rough grit sandpaper, or wax adhered to the shroud 12. Alternatively, in the shroud molding process, the inner surface 32 may be a roughened surface so as to provide the same function as sandpaper, or the surfaces 29 and 32 can be corresponding stepped surfaces.

The swirl and axial components of velocity now have to travel through or past a highly resistive path of fibers, foam, or a seal material. The sufficiently dense fibers, foam or other seal material cause an increase in the kinetic energy to be dissipated and dissipate the kinetic energy of the recirculating air flow in the direction of arrow C, thus reducing fan noise and increasing efficiency. The density of the seal structure also reduces the size of the gap 16 and increase the air resistance in the gap 16 to minimize axial leakage flow. The seal structure 30 may be in contact with the axially extending wall 26 of the rotor assembly 24, but a minimum clearance is preferred to reduce the contact noise and rotor torque.

Figure 3:
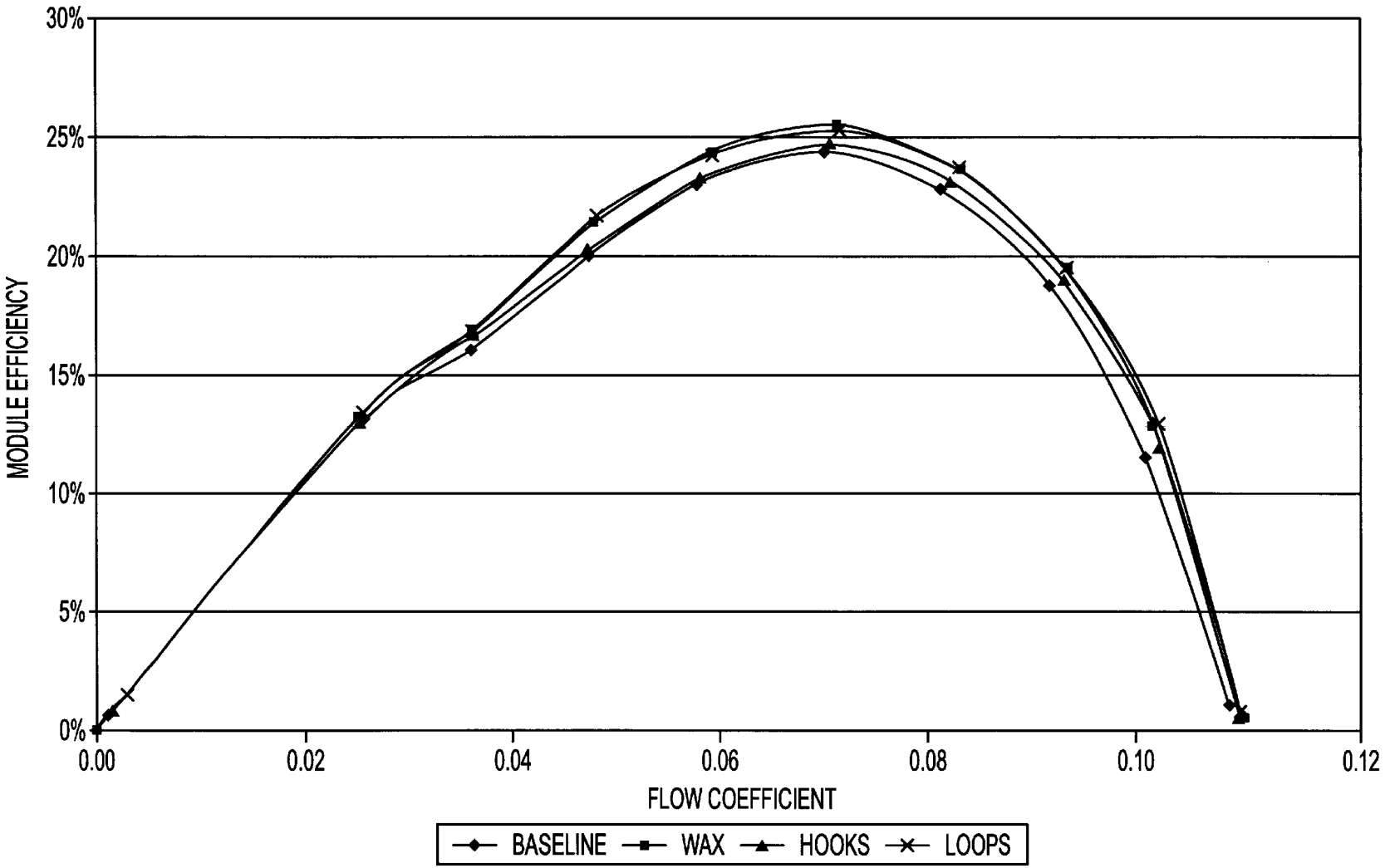
FIG. 3 is a graph of fan module efficiency versus flow coefficient showing comparisons between a conventional fan module and fan modules employing the seal structure of the invention.

FIG. 3 is a graph of fan module efficiency versus flow coefficient showing a comparison between a baseline or conventional fan module having no seal structure, and fan modules of the invention employing a wax seal structure, a seal structure comprising Velcro® hooks, and a seal structure comprising Velcro®) loops, disposed on surface 32 of the shroud 12. As shown, the seal structures of the invention improve the fan module efficiency.

Figure 4:
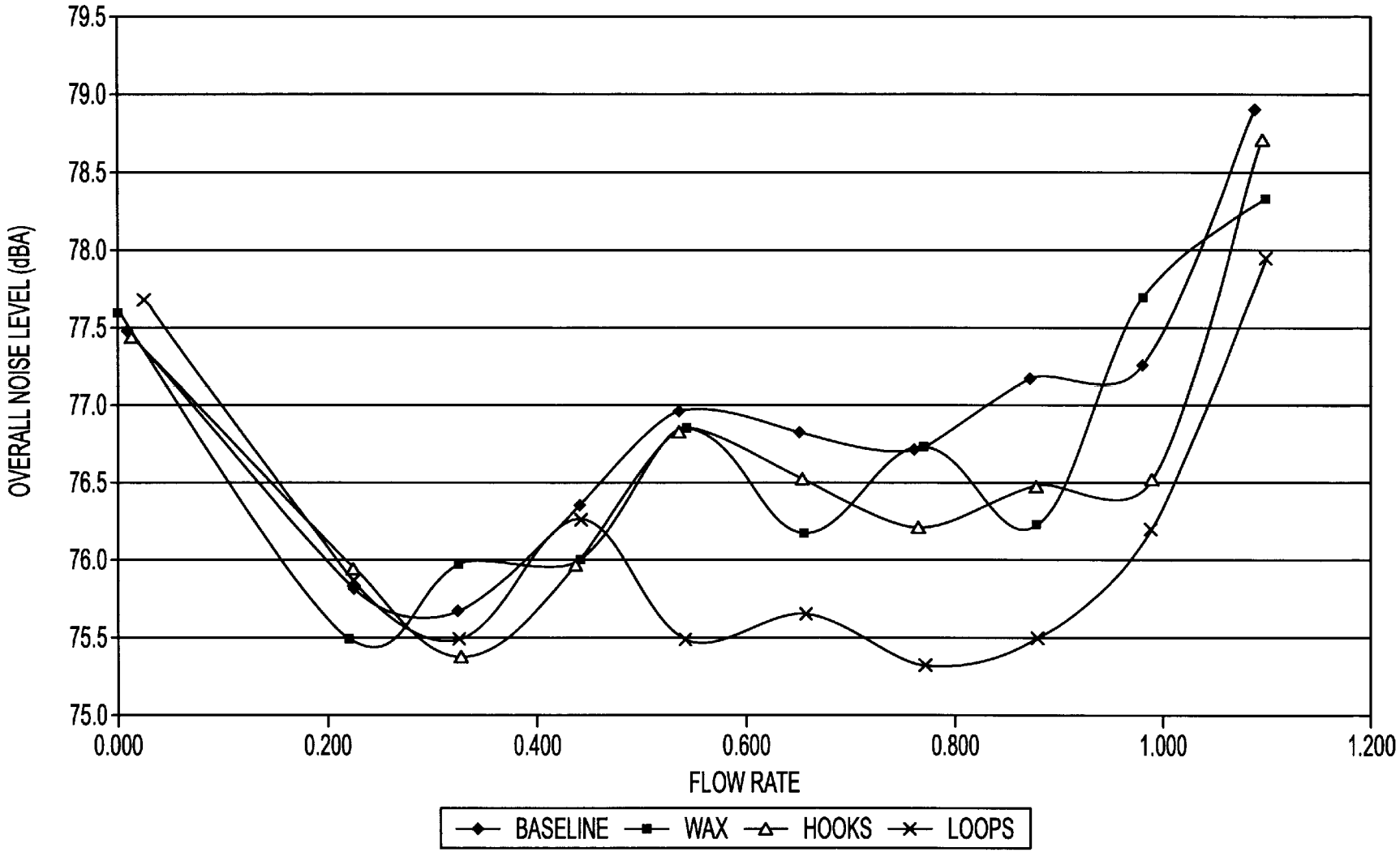
FIG. 4 is a graph of noise level versus flow rate showing comparisons between a conventional fan module and fan modules employing the seal structure of the invention.

FIG. 4 is a graph of fan module noise versus normalized flow rate showing a comparison between the baseline fan module having no seal structure, and fan modules of the invention employing a wax seal structure, a seal structure comprising Velcro® hooks, and a seal structure comprising Velcro® loops, disposed on surface 32 of the shroud 12. As shown, the seal structure of the invention reduces the overall noise level of the fan module.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A turbomachine for moving air comprising:

a shroud disposed about a longitudinal axis, a rotor assembly mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, and seal structure extending from substantially the inner entire surface of the shroud and into the gap to reduce swirl and minimize air leakage across the gap, wherein the seal structure comprises one of a plurality of fibers, a plurality of bristles and a plurality of filaments.

2. The turbomachine of claim 1, wherein the seal structure is mounted to the inner surface of the shroud.

3. The turbomachine of claim 2, wherein the seal structure is mounted to the inner surface by adhesive.

4. The turbomachine of claim 2, wherein the seal structure comprises a substrate having mounted thereon, said one of said plurality of fibers, said plurality of bristles and said plurality of filaments.

5. The turbomachine of claim 1, wherein the annular band has a radially extending wall and an axially extending wall coupled to the radially extending wall, the seal structure being provided between an outer surface of the axially extending wall and the inner surface of the shroud.

6. A turbomachine for moving air comprising:

a shroud disposed about a longitudinal axis, a rotor assembly mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, and seal structure extending from the inner surface of the shroud and into the gap to reduce swirl and minimize air leakage across the gap, wherein the seal structure comprises an air permeable foam material mounted directly on the inner surface of the shroud.

7. A turbomachine for moving air comprising:

a shroud disposed about a longitudinal axis, a rotor assembly mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, and seal structure extending from the inner surface of the shroud and into the gap to reduce swirl and minimize air leakage across the gap, wherein the inner surface the shroud includes a roughened surface defining the seal structure.

8. A turbomachine for moving air comprising:

a shroud disposed about a longitudinal axis, a rotor assembly mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, and seal structure extending from the inner surface of the shroud and into the gap to reduce swirl and minimize air leakage across the gap, wherein the inner surface of the shroud includes a roughened surface defining the seal structure, wherein the inner surface includes sandpaper mounted thereto defining the roughened surface.

9. A turbomachine for moving air comprising:

a shroud disposed about a longitudinal axis, a rotor assembly mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, and seal structure extending from the inner surface of the shroud and into the gap to reduce swirl and minimize air leakage across the gap, wherein the seal structure comprises wax adhered to the inner surface of the shroud.

10. A method of reducing effects of air flow between a shroud and a rotor assembly, the shroud being disposed about a longitudinal axis and the rotor assembly being mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, the method including:

providing seal structure extending from substantially the inner entire surface of the shroud and into the gap to reduce swirl and minimize air leakage across the gap, the seal structure comprising one of a plurality of fibers, a plurality of bristles and a plurality of filaments.

11. The method of claim 10, wherein the seal structure is mounted to the inner surface of the shroud.

12. The method of claim 11, wherein the seal structure is mounted to the inner surface by adhesive.

13. The method of claim 11, wherein the seal structure comprises a substrate having mounted thereon, said one of said plurality of fibers, said plurality of bristles and said plurality of filaments.

14. The method of claim 10, wherein the annular band has a radially extending wall and an axially extending wall coupled to the radially extending wall, the seal structure being provided between an outer surface of the axially extending wall and the inner surface of the shroud.

15. A method of reducing effects of air flow between a shroud and a rotor assembly, the shroud being disposed about a longitudinal axis and the rotor assembly being mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, the method including:

providing seal structure extending from the inner surface of the shroud and into the gap to reduce swirl an minimize air leakage across the gap, wherein the inner surface the shroud includes a roughened surface defining the seal structure.

16. A method of reducing effects of air flow between a shroud and a rotor assembly, the shroud being disposed about a longitudinal axis and the rotor assembly being mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, the method including:

providing seal structure extending from the inner surface of the shroud and into the gap to reduce swirl and minimize air leakage across the gap, wherein the inner surface of the shroud includes a roughened surface defining the seal structure, wherein sandpaper is mounted to the inner surface to define the roughened surface.

17. A method of reducing effects of air flow between a shroud and a rotor assembly, the shroud being disposed about a longitudinal axis and the rotor assembly being mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, the method including:

mounting an air permeable foam directly on the inner surface of the shroud so as to extend into the gap to reduce swirl and minimize air leakage across the gap.

18. A method of reducing effects of air flow between a shroud and a rotor assembly, the shroud being disposed about a longitudinal axis and the rotor assembly being mounted for rotation about the longitudinal axis, the rotor assembly having a plurality of blades, tips of the blades being coupled to an annular band, the annular band being disposed with respect to the shroud so as to define a gap extending continuously between an outer surface of the annular band and an inner surface of the shroud, the method including:

providing wax on the inner surface of the shroud so as to extend into the gap to reduce swirl and minimize air leakage across the gap.

* * * * *